US008069610B2

(12) United States Patent
Graf et al.

(10) Patent No.: US 8,069,610 B2
(45) Date of Patent: Dec. 6, 2011

(54) ADJUSTABLE WINDOW LIFTER GUIDE RAIL

(75) Inventors: Friedrich Graf, Eggenfelden (DE); Martin Feineis, Landshut (DE); Franz Sturm, Ergolding (DE)

(73) Assignee: Lisa Draexlmaier GmbH, Vilsbiburg (DE)

( * ) Notice: Subject to any disclaimer, the term of this patent is extended or adjusted under 35 U.S.C. 154(b) by 1181 days.

(21) Appl. No.: 11/725,150

(22) Filed: Mar. 16, 2007

(65) Prior Publication Data

US 2007/0214726 A1 Sep. 20, 2007

(30) Foreign Application Priority Data

Mar. 16, 2006 (DE) ..... 10 2006 012 176

(51) Int. Cl.
*E05F 11/38* (2006.01)

(52) U.S. Cl. ..... 49/348; 49/349; 49/212

(58) Field of Classification Search ..... 49/348, 49/349, 352, 212, 502
See application file for complete search history.

(56) References Cited

U.S. PATENT DOCUMENTS

| | | | | |
|---|---|---|---|---|
| 3,844,064 | A * | 10/1974 | Yamaha et al. | 49/348 |
| 4,586,290 | A * | 5/1986 | Juechter | 49/348 |
| 4,761,915 | A * | 8/1988 | Marz | 49/374 |
| 4,869,123 | A * | 9/1989 | Stocker | 74/501.5 R |
| 5,632,121 | A * | 5/1997 | Handte et al. | 49/502 |
| 5,960,588 | A * | 10/1999 | Wurm et al. | 49/352 |
| 6,425,208 | B1 * | 7/2002 | Klueger et al. | 49/502 |
| 2003/0131534 | A1 * | 7/2003 | Cardine et al. | 49/212 |
| 2006/0254146 | A1 * | 11/2006 | Florentin et al. | 49/349 |
| 2006/0283088 | A1 * | 12/2006 | Buchta | 49/352 |

FOREIGN PATENT DOCUMENTS

| | | | |
|---|---|---|---|
| DE | 10014946 | A1 | 9/2001 |
| DE | 10138586 | A1 | 3/2003 |
| DE | 20219264 | U1 | 4/2003 |

* cited by examiner

*Primary Examiner* — Gregory J. Strimbu
(74) *Attorney, Agent, or Firm* — Wolf, Greenfield & Sacks, P.C.

(57) ABSTRACT

A device and method for adjusting a mounting position of a window lifter guide rail of a motor vehicle window, particularly in a frameless motor vehicle door. The device comprises a locking member which includes a lower member, an upper member, and a screw that extends through the locking member. The screw is in engagement with a nut that may be rotated to adjust the mounting position of the guide rail in a vertical direction. The upper and lower members may also be moved relative to one another to adjust the mounting position of the guide rail in a horizontal direction.

19 Claims, 6 Drawing Sheets

ADJUSTABLE WINDOW LIFTER GUIDE RAIL

CROSS REFERENCE TO RELATED APPLICATION

Foreign priority benefits are claimed under 35 U.S.C. §119 (a)-(d) or 35 U.S.C. §365 (b) of German Application No. DE 10 2006 012 176.7, filed Mar. 16, 2006, which is hereby incorporated by reference in its entirety.

FIELD

Aspects of the present invention relate to devices and methods for adjusting a mounting position of a window lifter guide rail and/or for adjusting the inclination of the window pane itself.

RELATED ART

To prevent the entry of air and water, and to reduce driving noise, motor vehicle windows should lie flush with surrounding components when the window is in the closed position. In many vehicles, windows are guided between the open and closed positions by a frame that both guides the window toward the closed position and provides a sealing surface for the window. However, some vehicles, like coupés and convertibles, often lack frames such that the window of a door is positioned against other components of the vehicle when in the closed position, like the adjacent pillars of the vehicle body, the vehicle roof and/or the convertible top.

The applicants have appreciated that the ability to adjust the mounting position of frameless doors may help provide for an improved fit between a window and adjacent vehicle components. This adjustability can compensate for mismatches that may occur as a result of the cumulative tolerances that lie between the door, where the window is mounted, and the other components of the vehicle that are adjacent to the window when closed. The applicants have also appreciated that there is a need to provide for solid mounting of windows to compensate for vibrations of the motor vehicle, such as vibrations that may occur at high driving speed.

Adjustable window lifters are known, such as from DE 101 45 180 A1, which describes a window lifter with an adjustable inclination. However, this device only provides limited adjustability. Moreover, the device as shown may be difficult to access when mounted inside of a motor vehicle door.

The applicants have appreciated that benefits would be provided by a device that provides adjustability in multiple directions, such as in the direction that is orthogonal to the general plane defined by the door (the y-direction) and in the vertical direction, substantially parallel to the direction of motion of the window (the z-direction).

SUMMARY

According to one aspect of the invention, a device for adjusting a mounting position of the window lifter guide rail of a motor vehicle window in a frameless motor vehicle door is provided. The device comprises a locking member connectable to an inner door panel. The locking member comprises a lower member, an upper member engageable with the lower member, a nut, and a screw. The screw extends through at least one of the lower and upper members and is non-displaceably connected to the window lifter guide rail and in screw engagement with the nut. Rotation of the nut moves the screw and the guide rail in a substantially vertical direction.

The upper member and the lower member are displaceable relative to one another in a direction transverse to the substantially vertical direction and are lockingly engageable with one another in a plurality of different positions.

According to another aspect of the invention, a method of adjusting the mounting position of a window lifter guide rail of a motor vehicle window in a frameless motor vehicle door is provided. The method comprises providing a locking member that comprises a lower member, an upper member engageable with the lower member, a nut, and a screw. The screw extends through at least one of the lower and upper members and is non-displaceably connected to the window lifter guide rail and in screw engagement with the nut. Rotation of the nut moves the screw and the guide rail in a substantially vertical direction. The upper member and the lower member are displaceable relative to one another in a direction transverse to the substantially vertical direction and are lockingly engageable with one another in a plurality of different positions. The method also comprises pre-adjusting the locking member in the direction transverse to the substantially vertical direction and connecting the screw to the window lifter guide rail in a non-displaceable manner. The method also comprises inserting the screw through the locking member and mounting the nut to the screw, attaching the locking member to the inner door panel, and adjusting the guide rail of the window lifter in the substantially vertical direction by rotating the nut.

Various embodiments of the present invention provide certain advantages. Not all embodiments of the invention share the same advantages and those that do may not share them under all circumstances.

Further features and advantages of the present invention, as well as the structure of various embodiments of the present invention are described in detail below with reference to the accompanying drawings.

BRIEF DESCRIPTION OF THE DRAWINGS

The accompanying drawings are not intended to be drawn to scale. In the drawings, each identical or nearly identical component that is illustrated in various figures is represented by a like numeral. For purposes of clarity, not every component may be labelled in every drawing. Various embodiments of the invention will now be described, by way of example, with reference to the accompanying drawings, in which.

DETAILED DESCRIPTION

Figure 1:
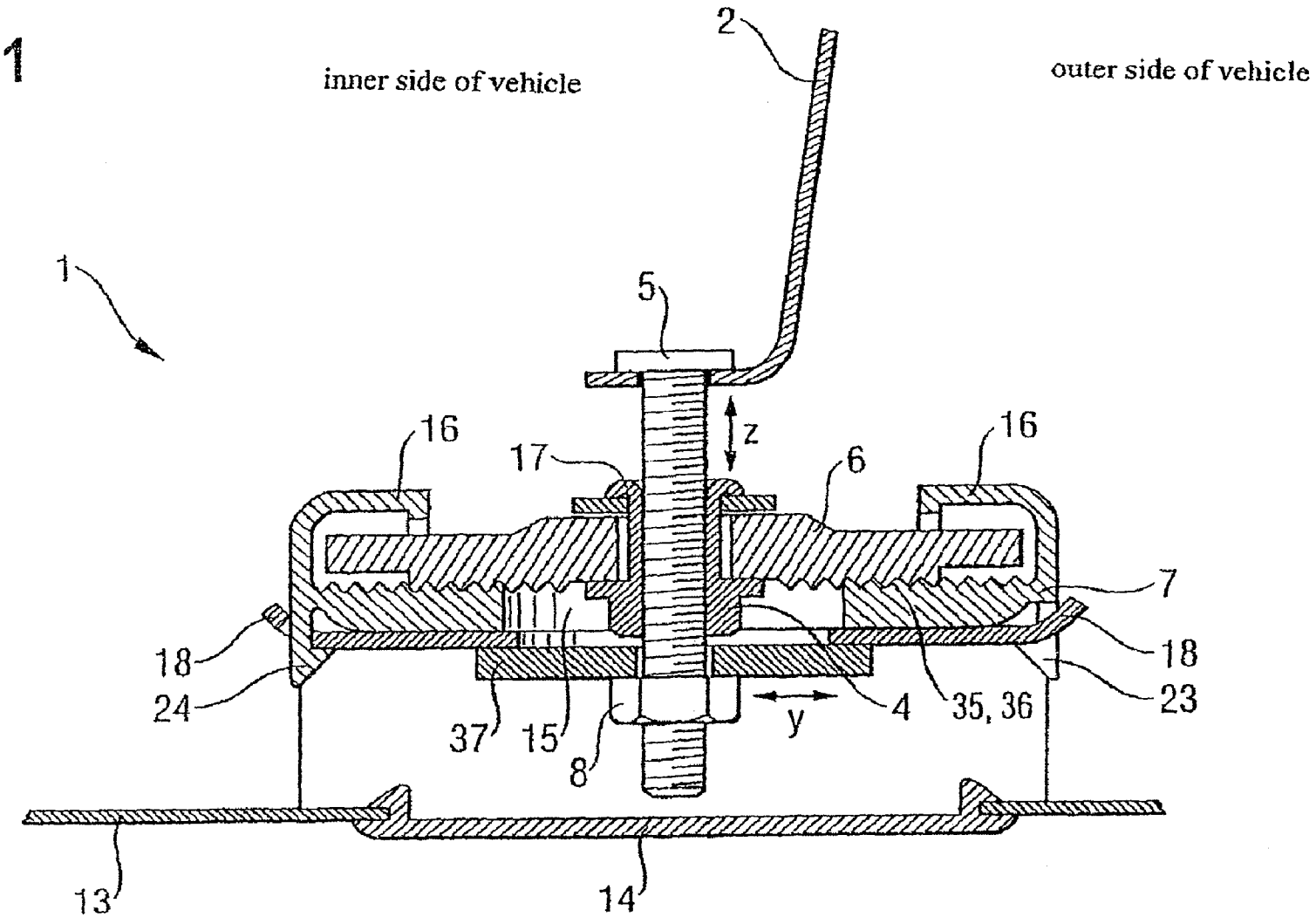
FIG. 1 is a sectional view of an adjustable window lifter according to a first embodiment of the invention.

According to one aspect of the invention, a device for adjusting the mounting position of a window in a frameless door is made easier. In particular, adjustments may be made easier by providing for adjustment in two different directions, such as in both the y-direction and the z-direction.

According to a first aspect of the present invention, a locking member is provided that can adjust the mounting position of a window lifter guide rail, upon which the window is permanently mounted. The locking member may comprise an upper member and a lower member. One of the upper and lower members may be attached to the structure of the vehicle door, and the other to the window lifter guide rail by a screw that is non-displaceably connected to the window lifter guide rail. The lower and upper members may be moved relative to one another in the y-direction (direction that lies substantially orthogonal to the general plane of the window) to provide for position adjustment of the window lifter guide rail relative to the door. Engagement features, such as toothed surfaces, may allow the upper and lower member to be fixed with respect to each other in various different positions to provide for a rigidly mounted window.

The locking member may also comprise features that provide for adjustment in the z-direction (i.e., the substantially vertical direction). The screw of the guide rail may be engaged to the locking member via a nut such that rotation of the nut causes the screw, and thus the window lifter guide rail, to move up or down relative to the door. Here, the screw may be non-rotatably connected to the window lifter guide rail such that rotation of the nut on the locking member causes a known displacement of the screw and the window lifter guide rail. However, it is to be appreciated that other arrangements are also possible, such as ones where the screw is mounted to the locking member and engages a rotatable nut that is part of the guide rail. Still, other constructions are possible, such as ones with a rotatable screw and stationary nut, as aspects of the invention are not limited in this respect.

Adjustment of the locking member in the y-direction may also allow the inclination of a window to be adjusted, according to some embodiments. An upper portion of the window lifter guide rail may be fixed to the door structure in a manner that limits relative motion in the y-direction, while allowing relative motion in the z-direction. In such a case, adjusting the locking member in the y-direction may cause the window to essentially pivot about the upper mounting point between the window and door, such that the inclination angle of the window can be adjusted. It is to be appreciated, however, that in some embodiments, the upper point of attachment between the window and door may provide for relative movement in the y-direction, as aspects of the invention are not limited in this respect.

The path of travel of the window, according to some embodiments, may be adjusted simply by altering the position of the window lifter guide rail. With such an arrangement, the window can be adjusted to a high degree by simply altering the adjustment features of the locking member. Where the configuration of a particular car door is known ahead of time, the locking member may be pre-adjusted to provide for optimal positioning of the window lifter guide rail, and thus the window itself. The locking member may be adjusted when the tolerances of a vehicle cause an improper window fit. In such circumstances, only minor adjustments may need to be made to the pre-adjusted locking member to position the window lifter guide rail properly.

The locking member may be readily accessed to be adjusted, even once positioned inside of a door panel. According to some embodiments, the removable panel is positioned on the door such that, when removed, easy access is provided to the locking member to make adjustments.

As mentioned above, according to some embodiments, an additional attachment point is provided between the window lifter guide rail and mating components. In many embodiments, this additional attachment point is provided near an end of the guide rail, and a point above the locking member, although other arrangements are possible. The additional attachment point may allow for some limited movement of the guide rail, such as displacement in the y-direction, z-direction, and/or some pivoting of the window. In this regard, adjustments can be made via the locking member without imparting stress to the guide rail. The additional attachment point may also comprise features that securely hold the window lifter guide rail to provide a rigid mounting while allowing limited movement.

Figure 9:
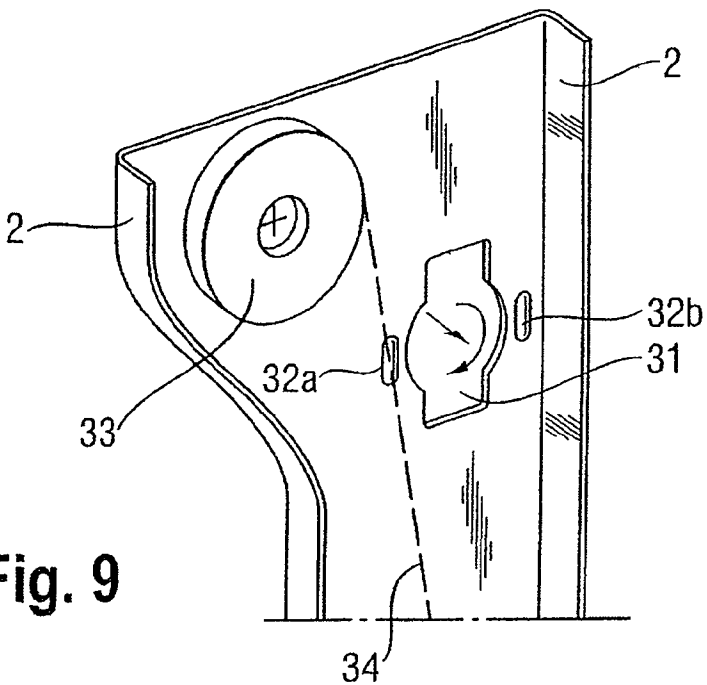
FIG. 9 shows an upper portion of the window lifter guide rail that may be connected to the area of the railing sheet shown in FIG. 8 at the upper attachment point.
Figure 10:
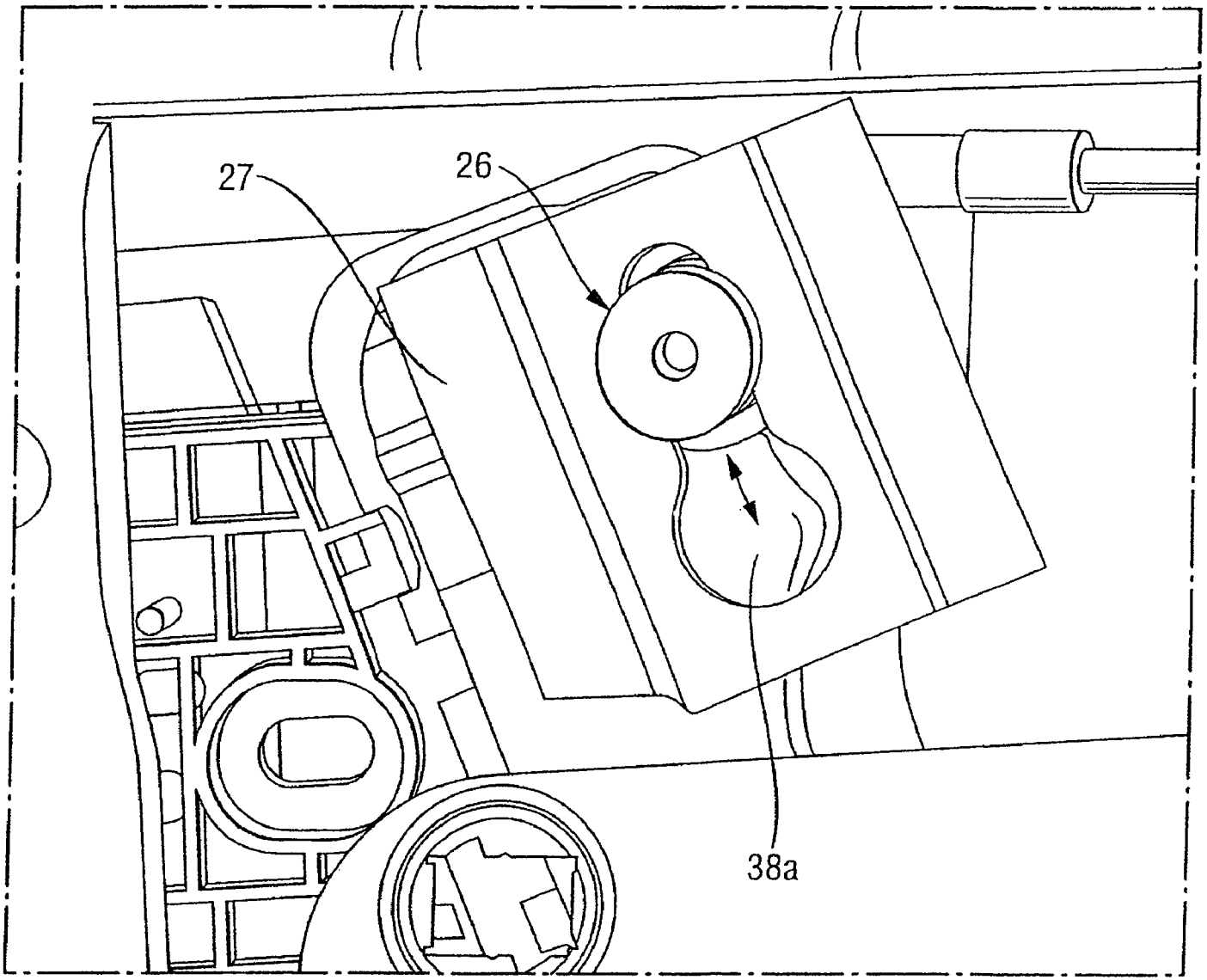
FIG. 10 shows an alternative embodiment of the upper attachment point between a window lifter guide rail and a railing sheet.

According to one embodiment, the additional attachment point is provided by a displaceable plastic member, as represented by a first embodiment shown in FIGS. 6 to 9, or by a second embodiment shown in FIG. 10. It is to be appreciated, however, that other configurations are also possible and that in some embodiments no additional attachment point may be necessary.

The locking member may be releasably mounted to the inner door panel. This may provide for a simplified assembly process, and a corresponding reduction in the time required to assemble a window to a door. According to some embodiments, the releasable mounting comprises a clip connection. The clip may include flexible locking noses that are inserted into corresponding receivers of a door, and that spring into place to hold the locking member to the door structure. The locking noses may be flexed to allow the locking member to be readily removed from the door as well, which may be necessary when the window is replaced or when other components of the door are serviced. It is to be appreciated that such clips may comprise various different arrangements, and may be made of a wide variety of materials, including plastic, metals, and the like.

The upper and lower members may include features to help hold the members in engagement with one another. According to some embodiments, the opposing faces of the upper and lower members have roughened surfaces that comprise teeth with similar step widths and depths. These teeth can help provide a secure engagement and finite number of adjustment positions between the upper and lower members. It is to be appreciated that roughened surfaces, other than teeth, may also be provided as the invention is not limited in this regard. According to some embodiments, the roughened surface may provide for an infinite number of adjustment positions between the upper and lower members.

A spring member may be incorporated into the locking member to press the upper and lower members into engagement with one another. Such spring members may provide the only force that holds the upper and lower members together, according to some embodiments. Here, the spring member may allow for easy relative adjustment between the upper and lower members. It is to be appreciated, however, that such spring members may also be used in combination with other fasteners. In these embodiments, when the other fasteners are loosened, the clip may simply provide enough force to hold the locking member together, such that an assembler may easily overcome the force of the spring to adjust the window position. According to some embodiments, the spring member is an integral part of the lower member and embraces the upper member to apply a force in the direction of the lower member. Other configurations are also possible, as aspects of the invention are not limited in this respect.

The upper and lower members may include features that facilitation relative movement in the y-direction. By way of example, in some embodiments, the screw that holds the guide rail to the locking member may extend completely through both the upper and lower members. Here, the lower member may include a slot, or oblong hole that allows the screw to pass therethrough. The slot also allows the upper member and screw to move relative to the lower member without the screw contacting the lower member. However, the ends of the slot may provide end stops that limit the extent of possible movement between the upper and lower members in the y-direction. In this regard, the slot may also help hold the locking member together when adjustments are being made.

The window lifter guide rail and screw may be mated together in various ways. According to some embodiments, the screw and the window lifter rail are non-displaceably connected by riveting. Such a connection provides for a simple, permanently secure, non-displaceable connection between the screw and guide rail. Other connections are also possible, as aspects of the invention are not limited in this respect. According to some embodiments, the window lifter guide rail and screw are welded to each other, and in other embodiments, the screw and the window lifter rail are glued to each other.

As mentioned above, embodiments may include a nut that, when rotated, causes vertical displacement of a screw that is attached to the window lifter guide rail. According to some embodiments, this function is accomplished by a bushing that is rotatably positioned in the upper member and that has internal threads that mate with the threads of the screw. The bushing may comprise a rivet nut with flanges that mate with the upper and lower surface of the upper member to provide support therebetween. The flanges may make direct contact with the upper member. Alternately, other components like washers, may be interposed between the rivet nut and upper or lower members, as aspects of the invention are not limited in this respect.

The locking member may be mounted to various features in the door panel. According to one embodiment, the locking member is mounted to a blank holder of the window lifter assembly. This blank holder may also provide a surface that interacts with the nut of the locking member for positioning the guide rail in the y-direction. The blank holder may be connected to the locking member by a clip connection, such as with locking noses that connect the blank holder. The same clip connection may also be used for joining the locking member to the inner door panel, according to some embodiments, although aspects of the invention are not limited in this regard.

The door where the locking member is mounted may include features to provide for easy inspection and adjustment of the locking member. In some embodiments, the inner door panel has an inspection hatch that is removably attached. The hatch may be positioned in line with the screw, such that removal provides direct access to rotate the screw.

The door panel may include features to help locate and/or hold a locking member in position. According to some embodiments, a functional support of the door panel is configured to receive the locking member and to prevent the locking member from rotating, such as about an axis that lies substantially along the vertical direction. The functional support may comprise ribs that extend outward from the door in the y-direction on either side of the locking member.

Additional features may also be provided that prevent unwanted rotation of the locking member. According to some embodiments, the window lifter guide rail may be connected to the guide rail at a second point, in addition to the point defined by the screw. This second connection point may prevent unwanted rotation of the guide rail about the axis defined by the screw. In some embodiments, this second connection point comprises a projection that extends laterally from the locking member and that includes a bore in which a fastener may be inserted to connect the locking member to the guide rail. Other arrangements are also possible, as aspects of the invention are not limited in this respect.

Aspects of the invention also comprise methods for adjusting the mounting position of the window lifter guide, particularly in a frameless motor vehicle door. According to some embodiments, the method comprises pre-adjusting the relationship between the upper and lower members, and between the screw and upper member to the target specifications of a particular frameless door. The window, along with the locking member, is then installed into the door. Adjustments, if necessary, are made in the z-direction by rotating the nut. Additionally, if adjustments are necessary in the y-direction, the upper and lower members are disengaged from one another and re-engaged in a proper position.

As discussed herein, the locking member may be pre-adjusted in the y-direction before assembling the door with the chassis of the motor vehicle. Any necessary readjustment in the y-direction and/or z-direction may be made after assembling the door and the chassis. In this respect, the amount of adjustment work required to properly position the guide rail may be minimized, particularly on an automotive assembly line where the window is assembled to the door.

According to another method, a pre-adjusted locking member may be installed and not readjusted until later in the assembly process. This may prove advantageous when components that mate with the window in the closed position are not yet installed on the vehicle. Here, readjustment in the y-direction and/or z-direction may be carried out via an opening in the inner door panel that provides access to the locking member. According to some embodiments, the opening may be covered by a removable hatch.

Turn now to the figures, and initially FIG. 1, which shows a sectional view of a first embodiment of the device 1 according to the invention. In the illustrated device, screw 5 is non-rotatably and non-displaceably connected to the window lifter guide rail 2 with epoxy resin at the head of screw 5. A movement of the screw 5 in the illustrated z-direction will thus also cause an equivalent movement of the window lifter guide rail 2. The screw 5 extends through the upper locking member 6 and the lower locking member 7. The screw 5 is engaged with internal threads of bushing 17 that connects the screw to the upper member 6 via rivet nut 4. Rotation of rivet nut 4 thus causes the screw to move in the z-direction relative to upper member 6. This adjustment is typically made with washer 37 and nut 8 removed to provide access to rivet nut 4.

Washer 37 and rivet nut 8 may be engaged with screw 5 and tightened to provide engagement forces between upper 6 and lower 7 locking members. Washer 37 is sized to allow compressed forces from nut 8 to be transmitted to lower locking member 7 so that the locking member may be held together.

The entire locking member 6, 7, as illustrated, is supported by and releasably mounted to blank holder 18 via clip connections. The clip connections include locking noses 23, 24 that are inserted into bores of blank holder 18. Locking noses 23, 24 are bent during the insertion process and spring back into their initial position after being installed. Engagement forces also exist between nut 8 and locking member 6, 7 indirectly through a washer 37 arranged between the blank holder 18 and the nut 8. Locking noses 23, 24, serve both to connect the locking member 6, 7 to the blank holder 18, and to connect the entire device 1 to the inner door panel 13.

The embodiment illustrated in FIG. 1 may have the upper and lower members 6, 7 be pre-adjusted in the y-direction and held together by teeth 35, 36. Spring member 16 may hold teeth 35, 36 in engagement with one another until nut 8 is fastened to screw 5. In this respect, device 1 may be held together as a unit before being assembled to the door of a vehicle. If adjustment is required in the y-direction, the upper member 6 and lower member 7 may be separated by applying a force against the upper member 6 to overcome the force applied by the spring members 16 and to lift the teeth 35, 36 out of engagement with one another. The upper and lower locking members can then be adjusted relative to one another in the y-direction.

As discussed herein, adjustments may be made even if screw 5 is already inserted in the locking member 6, 7. Screw 5 may easily be moved along elongated hole 15 in the lower member 7 to accommodate a readjustment of the locking member 6, 7 in the y-direction. Additionally, an adjustment of the device 1 in the z-direction can also be carried out after the device 1 has been connected to the inner door panel 13. Here inspection hatch 14, which covers the access opening in the inner door panel 13, may be removed to provide access to device 1.

Figure 2:
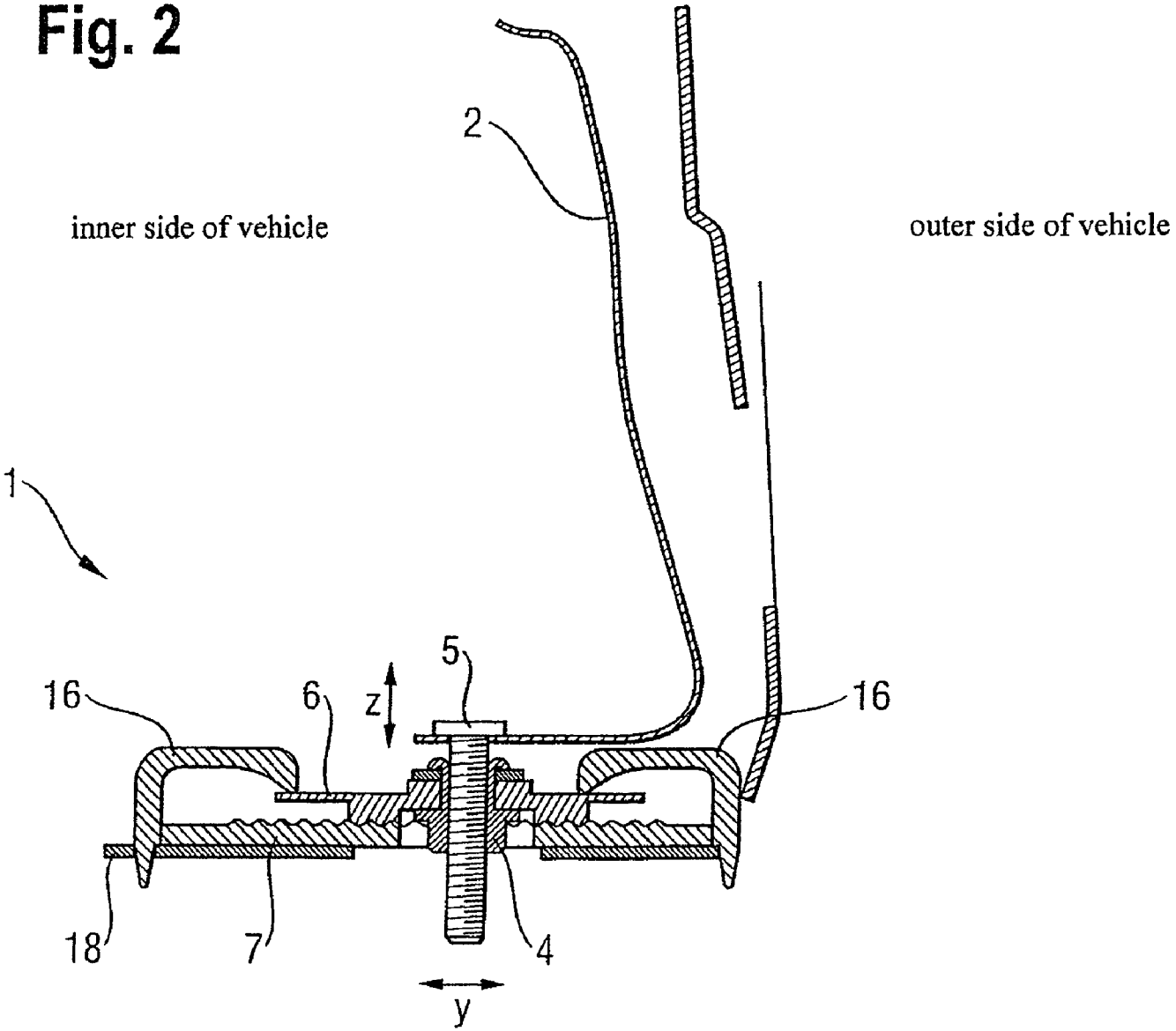
FIG. 2 is a sectional view of an adjustable window lifter according to a second embodiment.

FIG. 2 shows a second embodiment of a device 1, in which lower member 7, upper member 6, and blank holder 18 differ from that shown in the embodiment of FIG. 1. Here, upper member 7 is also adjusted via a rotatable threaded nut 4 that engages screw 5. As shown in FIG. 2, spring members 16 are not an integral part the lower member 7, but are rather formed as separate components.

Figure 3:
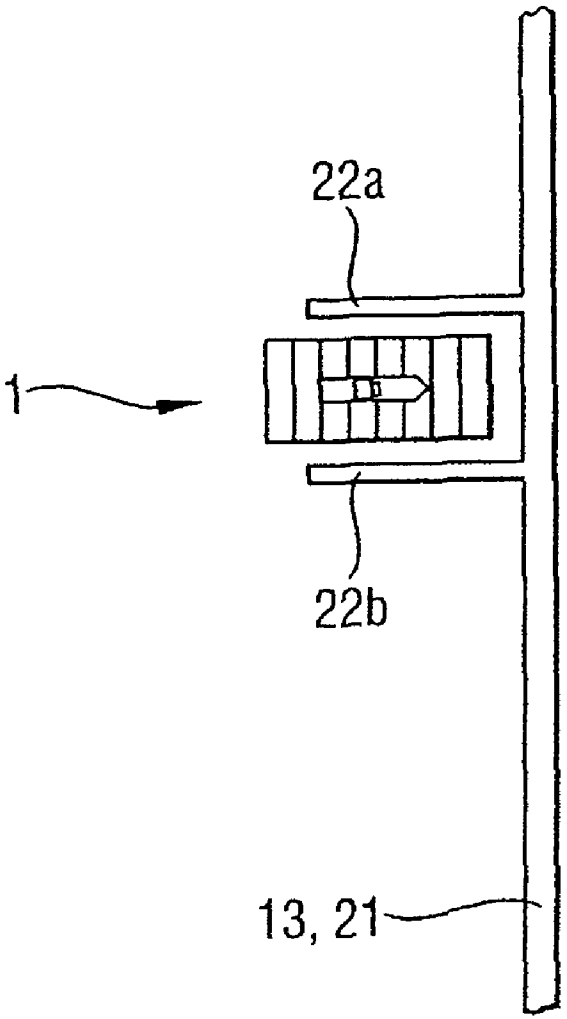
FIG. 3 is a top view, schematic arrangement of an adjustable window lifter positioned on a functional support.

FIG. 3 shows a schematic top view of a device 1 arranged between two ribs 22*a*, 22*b*, that aid installation of device 1 and prevent rotation of device 1. As shown, ribs 22*a*, 22*b* are an integral part of a functional support 21, which is connected to the inner door panel 13. However, in other embodiments the functional support may comprise an independent component. Additionally, the device may also be supported directly on the inner door panel 13.

Figure 4:
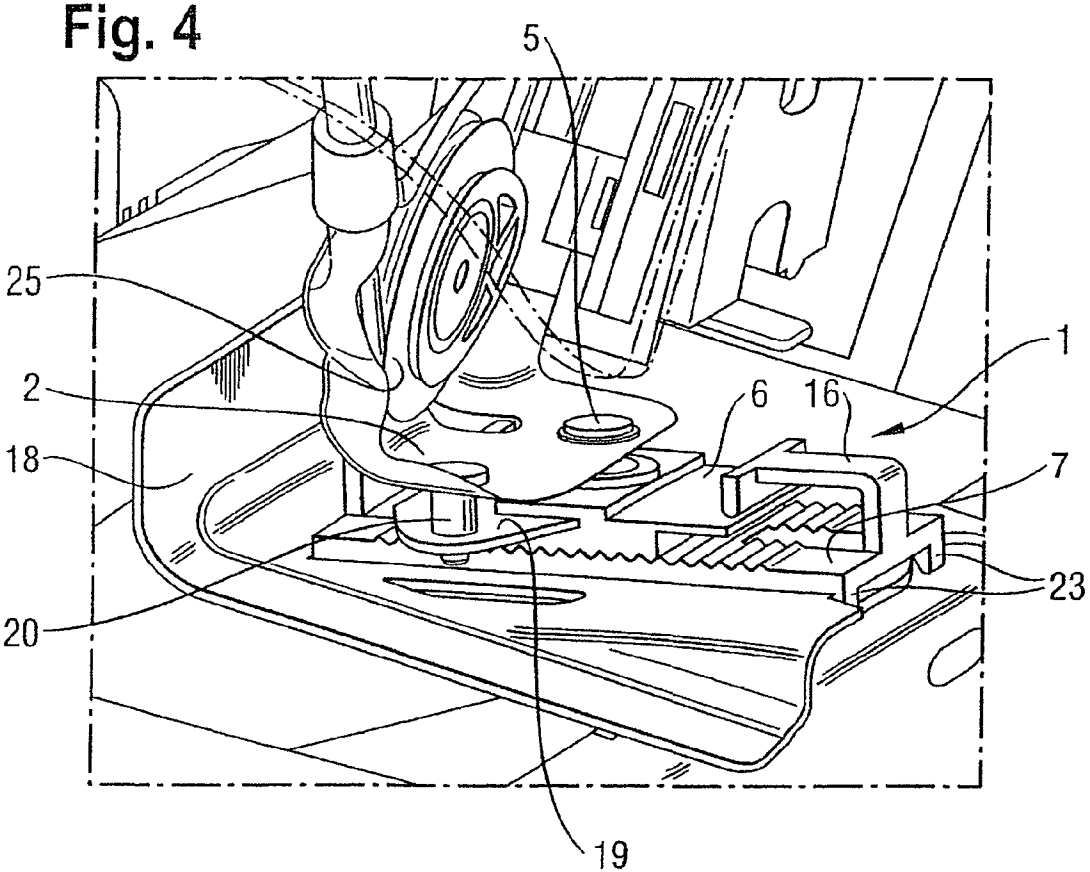
FIG. 4 is a perspective view of an adjustable window lifter according to a third embodiment.

FIG. 4 shows yet another embodiment of a device 1, according to the present invention. As shown, locking members 6, 7 are connected to the blank holder 18 via locking members 23. In this embodiment, prestress between the lower member 7 and the upper member 6 is also applied by means of a spring member 16, which is part of the lower member 7 and which is supported on the upper member 6. The screw 5, which extends through the locking members 6, 7 and the blank holder 18, and that engages nuts (not shown) for an adjustment in the z-direction, is non-displaceably connected to a base portion of the window lifter guide rail 2. Cable pulley 25 for the window lifter mechanism is also connected to the window lifter guide rail 2. To prevent the window lifter guide rail 2 from rotating about the longitudinal axis of screw 5 during adjustment in the z-direction, an additional attachment point is provided between the guide rail 2 and device 1. As shown, this additional attachment point comprises a screw 20 that extends through the base of the window lifter guide rail 2 and engages in a bore on a lateral projection 19 of the upper member 6.

Figure 5:
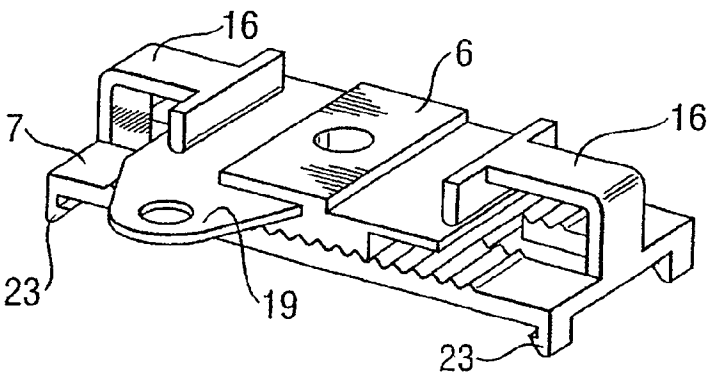
FIG. 5 is a perspective view of a locking member incorporated into the embodiment of FIG. 4.

FIG. 5 illustrates, in an unmounted state, locking members 6, 7 of the embodiment shown in FIG. 4. Lower member 7 is substantially symmetrical, with the locking noses 23 and spring member 16 that are shown on the right side of FIG. 5 also being included on the left side of the Figure. In contrast thereto, the upper member 6 is formed asymmetrically, with a bore for a screw (not shown) located on projection 19. The bore is arranged to be offset with respect to the bore for the adjusting screw (not shown), both laterally and in the longitudinal direction of the locking member 6, 7.

Figure 6:
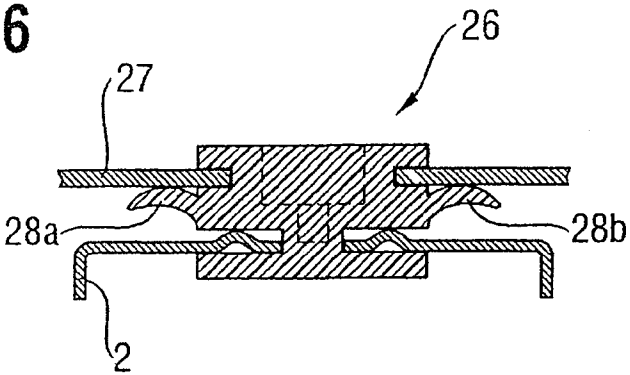
FIG. 6 is a cross-sectional view of an attachment member for attaching an upper point of the window lifter guide rail to a mating structure while still providing for adjustability.

FIG. 6 shows a cross-sectional view of a displaceable slide member 26 which may be used to provide an additional attachment point between railing sheet 27 and the window lifter guide rail 2. The slide member 26 comprises two pairs of receivers arranged in parallel, which may engage edge portions of the railing sheet 27 and the window lifter guide rail 2. The slide member 26 and the railing sheet 27 may be held together by forces that are applied by lateral spring members 28*a*, 28*b*.

Figure 7:
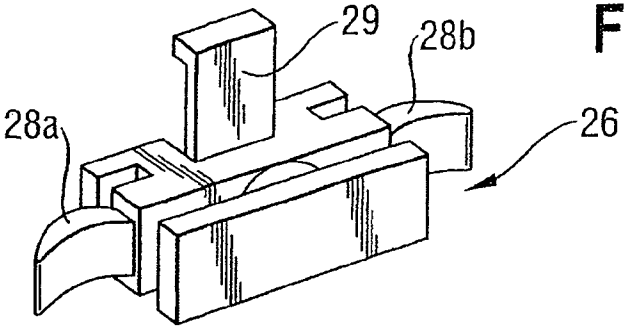
FIG. 7 is a perspective view of the attachment member shown in FIG. 6.

FIG. 7 shows a perspective view of the slide member 26 represented in FIG. 6. In addition to the spring members 28*a*, 28*b*, the slide member 26 may also comprise a disengagement prevention mechanism 29, the distal end of which has a projection protruding from the plane defined by the receivers for the railing sheet (not shown).

Figure 8:
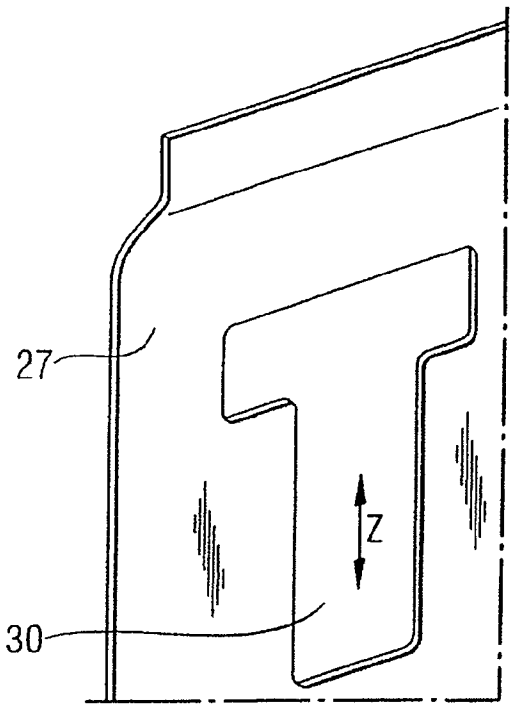
FIG. 8 is a perspective view of an area of a railing sheet on which the upper attachment point of the window lifter guide rail is provided.

FIG. 8 shows a schematic perspective view of a part of the railing sheet 27, including an upper attachment point. Railing sheet 27 includes a substantially T-shaped opening, the upper essentially horizontal leg having a width that allows insertion of the slide member (not shown) in the widthwise direction. The distance between the railing sheet edges that define the lower leg of the opening 30 may be selected to correspond with the width of the slide member (not shown) and the receivers arranged therein. This may enable the slide member (not shown) to slide along the vertical leg of the opening 30. Moreover, the length and the arrangement of the disengagement prevention mechanism 29 shown in FIG. 7 may be selected such that the slide member 26 may not pass over from the vertical part of the opening 30 to the horizontal part unless the disengagement prevention mechanism 29 is first moved out of the way such as by being bent.

FIG. 9 shows a schematic perspective view of the upper portion of the window lifter guide rail 2 that is to be mounted on the railing sheet 27 shown in FIG. 8 with the slide member 26 of FIGS. 6 and 7. As shown, the window lifter guide rail 2 has an opening 31 through which slide member 26 can be inserted when rotated in the longitudinal direction of the guide rail 2. After insertion, the slide member may be rotated by 90 degrees in a clockwise direction such that the edge portions of the guide rail 2 about opening 31 will engage the receivers of slide member 26. In the illustrated embodiment, the spring members 28*a*, 28*b* shown in FIG. 7 engage the receivers 32*a*, 32*b* arranged alongside the opening 31 to prevent rotation of the slide member in guide rail 2. Guide rail 2 also comprises deflection pulley 33, in the vicinity of the attachment point, for cable pull 34 of the window lifter mechanism (not shown).

FIG. 10 shows an alternative embodiment of the window lifter guide rail 2 (not shown here) including railing sheet 27. As shown, slide member 26 has an essentially cylindrical shape of a diameter smaller than that of the insertion area 38*a* of the opening in the railing sheet 27, but larger than the distance between adjacent edge portions of the railing sheet 27 along the displacement path of the slide member 26 in the railing sheet 27.

Having thus described several aspects of at least one embodiment of this invention, it is to be appreciated that various alterations, modifications, and improvements will readily occur to those skilled in the art. Such alterations, modification, and improvements are intended to be part of this disclosure, and are intended to be within the spirit and scope of the invention. Accordingly, the description and drawings herein are by way of example only.

What is claimed is:

1. A device for adjusting a mounting position of a window lifter guide rail of a motor vehicle window in a frameless motor vehicle door, the device comprising:

a locking member connectable to an inner panel of the door, the locking member comprising:

a lower member;

an upper member engageable with the lower member;

a nut;

at least one spring member that urges the upper and lower members into engagement with one another; and a screw that extends through at least one of the lower and upper members, the screw being non-displaceably connected to the window lifter guide rail and in threaded engagement with the nut, wherein rotation of the nut relative to the screw moves the screw and the guide rail in a substantially vertical direction which is substantially parallel to a longitudinal axis of the window lifter guide rail;

wherein the upper member and the lower member are displaceable relative to one another in a first direction transverse to the substantially vertical direction and are lockingly engageable with one another in a plurality of different positions.

2. The device according to claim 1, wherein the window lifter guide rail is mounted on the frameless motor vehicle door, wherein the frameless motor vehicle door is one of a coupé and a convertible motor vehicle door.

3. The device according to claim 1, wherein the locking member is releasably attached to the inner door panel.

4. The device according to claim 3, wherein the locking member is releasably attached to the inner door panel by a clip connection.

5. The device according to claim 1, wherein opposed faces of the lower member and the upper member each comprise toothed surfaces configured to engage one another.

6. The device according to claim 1, wherein the at least one spring member is an integral part of the lower member and the lower member embraces the upper member.

7. The device according to claim 1, wherein the screw is riveted to the window lifter rail.

8. The device according to claim 1, wherein the screw is welded to the window lifter rail.

9. The device according to claim 1, wherein the screw is glued to the window lifter rail.

10. The device according to claim 1, wherein a bushing with inside threads extends through the upper member and is in engagement with the screw such that the bushing is displaced along the screw when rotated relative to the screw.

11. The device according to claim 10, wherein the bushing comprises a flange which is at least partially supported by the upper member.

12. The device according to claim 1, wherein the locking member is mounted on a blank holder.

13. The device according to claim 1, wherein the inner door panel comprises a removable inspection hatch positioned adjacent the screw.

14. The device according to claim 1, wherein the lower member of the locking member includes an elongated hole through which the screw passes, the elongated hole extending in a first direction transverse to the substantially vertical direction.

15. The device according to claim 1, further comprising:

a locking mechanism that prevents rotation of the window lifter guide rail.

16. The device according to claim 15, wherein the locking mechanism is a projection that extends from the locking member and fits into the window lifter guide rail.

17. A method of adjusting a mounting position of a window lifter guide rail of a motor vehicle window in a frameless motor vehicle door, comprising:

providing a locking member connectable to an inner panel of the door, the locking member comprising:

a lower member;

an upper member engageable with the lower member;

a nut;

at least one spring member that urges the upper and lower members into engagement with one another; and a screw that extends through at least one of the lower and upper members, the screw being non-displaceably connected to the window lifter guide rail and in threaded engagement with the nut, wherein rotation of the nut relative to the screw moves the screw and the guide rail in a substantially vertical direction which is substantially parallel to a longitudinal axis of the window lifter guide rail;

wherein the upper member and the lower member are displaceable relative to one another in a direction transverse to the substantially vertical direction and are lockingly engageable with one another in a plurality of different positions.

18. The method according to claim 17, further comprising:

adjusting the locking member in the direction transverse to the substantially vertical direction before assembling the locking member to the frameless motor vehicle door.

19. The method according to claim 18, further comprising:

readjusting the locking member in the direction transverse to the substantially vertical direction via an opening in the inner door panel.

* * * * *